US005279050A

United States Patent [19]

Törmänen

[11] Patent Number: 5,279,050

[45] Date of Patent: Jan. 18, 1994

[54] GROUPING OF CYLINDERS IN THE DRYING SECTION OF A PAPER MACHINE

[75] Inventor: Aimo Törmänen, Jyväskylä, Finland

[73] Assignee: Valmet Paper Machinery Inc., Finland

[21] Appl. No.: 57,706

[22] Filed: May 4, 1993

Related U.S. Application Data

[63] Continuation of Ser. No. 920,794, Jul. 28, 1992, abandoned.

[30] Foreign Application Priority Data

Jul. 31, 1991 [FI] Finland ..... 913648

[51] Int. Cl.[5] ..... F26B 13/08

[52] U.S. Cl. ..... 34/117; 34/120

[58] Field of Search ..... 34/117, 116, 113, 114, 34/115, 120, 121

[56] References Cited

U.S. PATENT DOCUMENTS 4,882,855 11/1989 Loser et al. ..... 34/116

5,105,561 4/1992 Wulz ..... 34/117

FOREIGN PATENT DOCUMENTS 1931922 1/1971 Fed. Rep. of Germany .

3910600 10/1990 Fed. Rep. of Germany .

3910612 10/1990 Fed. Rep. of Germany .

513538 10/1939 United Kingdom .

8706635 11/1987 World Int. Prop. O. .

9012150 10/1990 World Int. Prop. O. .

*Primary Examiner*—Henry A. Bennet

*Attorney, Agent, or Firm*—Steinberg & Raskin

[57] ABSTRACT

The invention relates to a grouping of cylinders in a drying section of a paper machine, in which drying section a paper web and a wire are carried meandering from a first heated drying cylinder onto a leading cylinder and from the leading cylinder further onto the next heated drying cylinder. A drying group consists of a number of subsequent groupings of cylinders, whereby, in each grouping of cylinders, the drying cylinders and the leading cylinders are placed, in relation to one another, substantially at three different height levels, so that the drying cylinders with larger diameter are placed at a height level $Y_1$ and the drying cylinders that have a diameter smaller than said larger diameter are placed at a height level $Y_2$. In the groupings of cylinder the leading cylinders are placed at a third height level $Y_3$.

16 Claims, 3 Drawing Sheets

GROUPING OF CYLINDERS IN THE DRYING SECTION OF A PAPER MACHINE

This is a continuation of application Ser. No. 07/920,794, filed Jul. 28, 1992, now abandoned.

BACKGROUND OF THE INVENTION

The invention concerns a grouping of the cylinders in the drying section of a paper machine.

In prior art constructions of drying sections in paper machines, the drying section consists of drying groups. Each drying group comprises heated drying cylinders and cold leading cylinders placed in different levels. The paper web, supported by the wire, is passed in a meandering fashion from a drying cylinder onto a leading cylinder and further from the leading cylinder onto the next drying cylinder. The drying cylinders are placed in the same level in relation to one another and in a level different from the level of the leading cylinders.

In prior art constructions of drying sections, the overall length of the drying section is remarkably long. However, the overall length of the drying section affects the requirement of the building area of the paper mill. If it is possible to reduce the length of the drying section, it is also possible to lower the building cost required by the paper machine in the same proportion.

OBJECTS AND SUMMARY OF THE INVENTION

Thus, it is an object of the present invention to provide a drying section of a novel type for a paper machine, which is considerably shorter than prior art drying sections, yet having an equivalent drying capacity and an equal number of cylinders.

The object of the present invention has been achieved by means of a novel grouping of the heated drying cylinders and the cold leading cylinders in the drying section of the paper machine. As a result of the grouping, the overall length required by the drying section can be reduced considerably. However, the drying section in the present invention has a drying capacity equal to that of a prior art drying section with the same number of cylinders.

According to the present invention, the drying section is arranged such that it comprises heated drying cylinders of two sizes. The drying cylinders of larger diameter are placed at a first height level. In a corresponding way, the drying cylinders of smaller diameter are placed at a second height level different than the first height level. Preferably, the drying cylinders are steam-heated.

In one embodiment of the invention, the drying section comprises cold leading cylinders, which are placed at two different height levels, i.e. at a height level $Y_3$ and at a height level $Y_2'$, the latter height level being substantially the same as that of the drying cylinders of smaller diameter. The paper web and a wire are passed in a meandering fashion from a drying cylinder of larger diameter onto a leading cylinder and from the leading cylinder onto a drying cylinder of smaller diameter. From the drying cylinder of smaller diameter the paper web and the wire are passed onto a second leading cylinder and from the leading cylinder onto a second heated drying cylinder of larger diameter.

By means of the above grouping of cylinders and choice of diameters of drying cylinders, it is possible to form, for example, a drying section whose overall length is 18 meters shorter, when compared with a prior art 71-cylinder Sym-Run drying section.

BRIEF DESCRIPTION OF THE DRAWINGS

The following drawings are illustrative of embodiments of the invention and are not meant to limit the scope of the invention as encompassed by the claims.

DETAILED DESCRIPTION OF THE PREFERRED EMBODIMENTS

Figure 1:
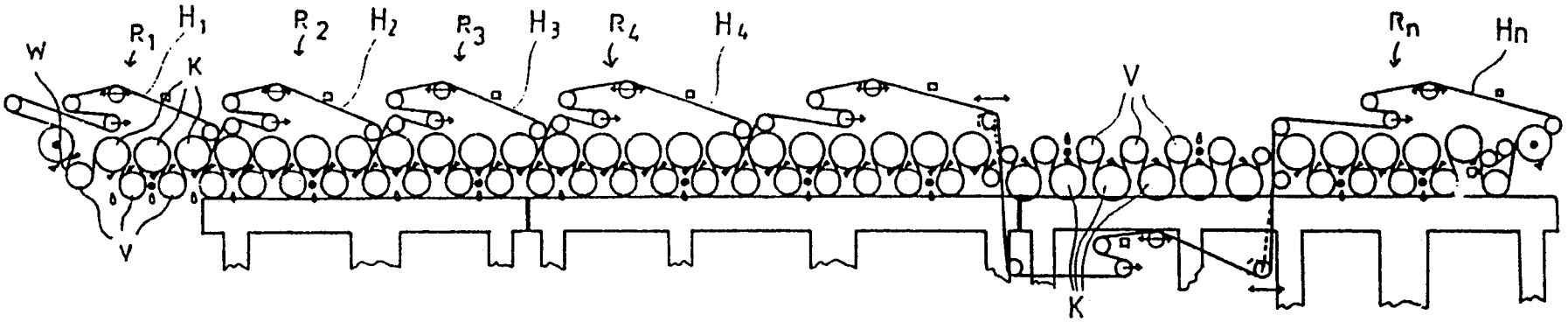
FIG. 1 shows a prior art drying section.

Referring to FIG. 1, a prior art drying section is shown and consists of groups $R_1$, $R_2$ . . . $R_n$ of drying cylinders. Each group $R_1$, $R_2$,$R_3$,$R_4$ . . . $R_n$ of drying cylinders comprises hot, preferably steam-heated drying cylinders of larger diameter and smaller cold, so-called leading cylinders, placed at a different level from the level of the drying cylinders. In each group $R_1$,$R_2$ . . . , the paper web is passed, supported by the wire H, from a drying cylinder K onto a leading cylinder V placed at a different level and further from the leading cylinder V back onto a heated drying cylinder placed at the same level as the first drying cylinder.

FIG. 1 shows a construction of a drying section that comprises seven groups of drying cylinders. The second group from the end is an inverted group, in which the steam-heated drying cylinders K are placed at a lower level and the cold leading cylinders V are placed at a higher level above the drying cylinders K.

In drying sections of this type, the leading cylinders are preferably perforated Uno-Vac cylinders, into which an internal negative pressure is introduced. The negative pressure is allowed to act upon the entire space in the interior of the drying cylinder, so that the web is kept in contact with the wire and also the web is kept on the cylinder in the web draws in which the web W is not supported by a wire.

Figure 2:
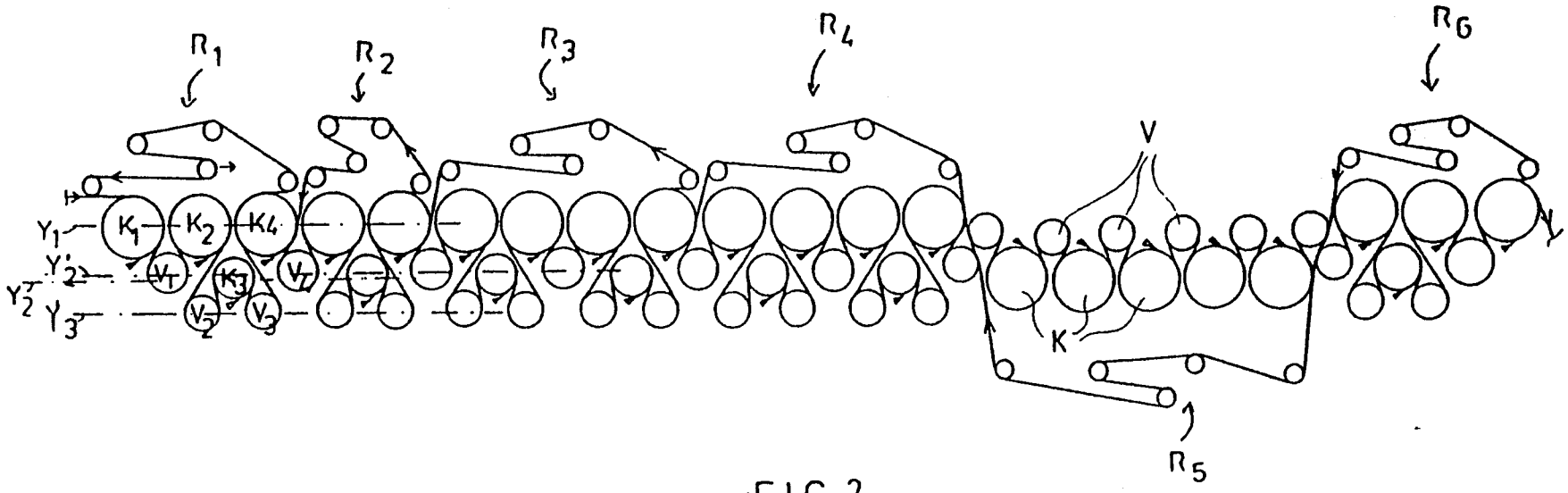
FIG. 2 shows a drying section in accordance with the invention.

FIG. 2 shows an improvement over the prior art illustrated in FIG. 1. In the construction of FIG. 2, the length of the drying section is reduced significantly by arranging the drying groups via a novel grouping of the drying cylinders and leading cylinders. In the embodiment shown in FIG. 2, there are six drying groups $R_1$ . . . $R_6$. The second group $R_5$ from the end being a so-called inverted group, in which the steam-heated drying cylinders K are placed at the lower level and the leading cylinders V at a higher level above the steam-heated drying cylinders K.

The groups $R_1$ ... $R_4$ and $R_6$ are provided with a grouping of the heated drying cylinders K and of the leading cylinders V in accordance with the present invention. The whole drying section comprises 28 steam-heated drying cylinders K and 29 cold cylinders, i.e. leading cylinders V.

In the embodiment shown in FIG. 2, the heated drying cylinders K in a drying group R are placed in relation to one another such that a drying cylinder K of smaller diameter is placed at a height level $Y_2$, which is a height level different from the height level $Y_1$ of the drying cylinders K of larger diameter. The leading cylinders V are placed at the height level $Y_2'$ and at the height level $Y_3$.

The paper web W is passed, e.g. in the drying group $R_1$, from the leading cylinder $V_1$ placed at the height level $Y_2'$ onto the drying cylinder $K_2$ placed at the height level $Y_1$. From the drying cylinder $K_2$, the web is passed onto the leading cylinder $V_2$ placed at the height level $Y_3$. From leading cylinder $V_2$, the web is passed onto the heated drying cylinder $K_3$ of smaller diameter placed at the height level $Y_2$. From the heating cylinder $K_3$, the web W is passed onto the leading cylinder $V_3$ laced at the height level $Y_3$. From the leading cylinder $V_3$, the web is then passed onto the drying cylinder $K_4$ placed at the height level $Y_1$. From the drying cylinder $K_4$, the web W is further passed onto the leading cylinder $V_4$ placed at the height level $Y_2'$.

In a corresponding manner, the wire $H_1$ is passed so that in connection with the heated drying cylinders $K_2$ and $K_4$, the paper web W runs between the wire $H_1$ and the face of the drying cylinders $K_2$ and $K_4$, and in connection with the leading cylinders $V_2$ and $V_3$, the web W runs outermost. Correspondingly, in connection with the drying cylinder $K_3$ with smaller diameter, the paper web W runs between the drying cylinder $K_3$ and the wire $H_1$.

In the groups $R_1$, $R_2$, $R_3$, $R_4$ and in the group $R_6$, the hot drying cylinders K and the leading cylinders V are placed, in a preferred embodiment, at four different height levels $Y_1, Y_2, Y_2', Y_3$. The hot drying cylinders K are placed at two different levels $Y_1, Y_2$ and the leading cylinders V at the level $Y_2'$ and at the level $Y_3$.

In another embodiment, the height levels $Y_2$ and $Y_2'$ are substantially equal to one another. The level $Y_2'$ is placed slightly higher than the level $Y_2$.

In yet another embodiment, the diameter dimensions of the leading cylinders V placed at the levels $Y_2'$ and $Y_3$ are slightly different from one another. The leading cylinders V at the level $Y_2'$ have a slightly larger diameter than the leading cylinders V at the level $Y_3$. The diameters of both of the leading cylinders V placed at the levels $Y_3$ and $Y_2'$ are slightly smaller than the diameters of the heated drying cylinders R placed at the height level $Y_2$. The diameter of the drying cylinder K placed at the middle height position $Y_2$ is smaller than the diameter of the drying cylinders K placed at the first height level $Y_1$.

In accordance with the present invention, between the drying cylinders K and the leading cylinders V, a novel grouping has been provided which results in considerable economies of space in the machine direction. The drying capacity is good and corresponds to that of a prior art drying section of equal number of cylinders and larger length.

Figure 3:
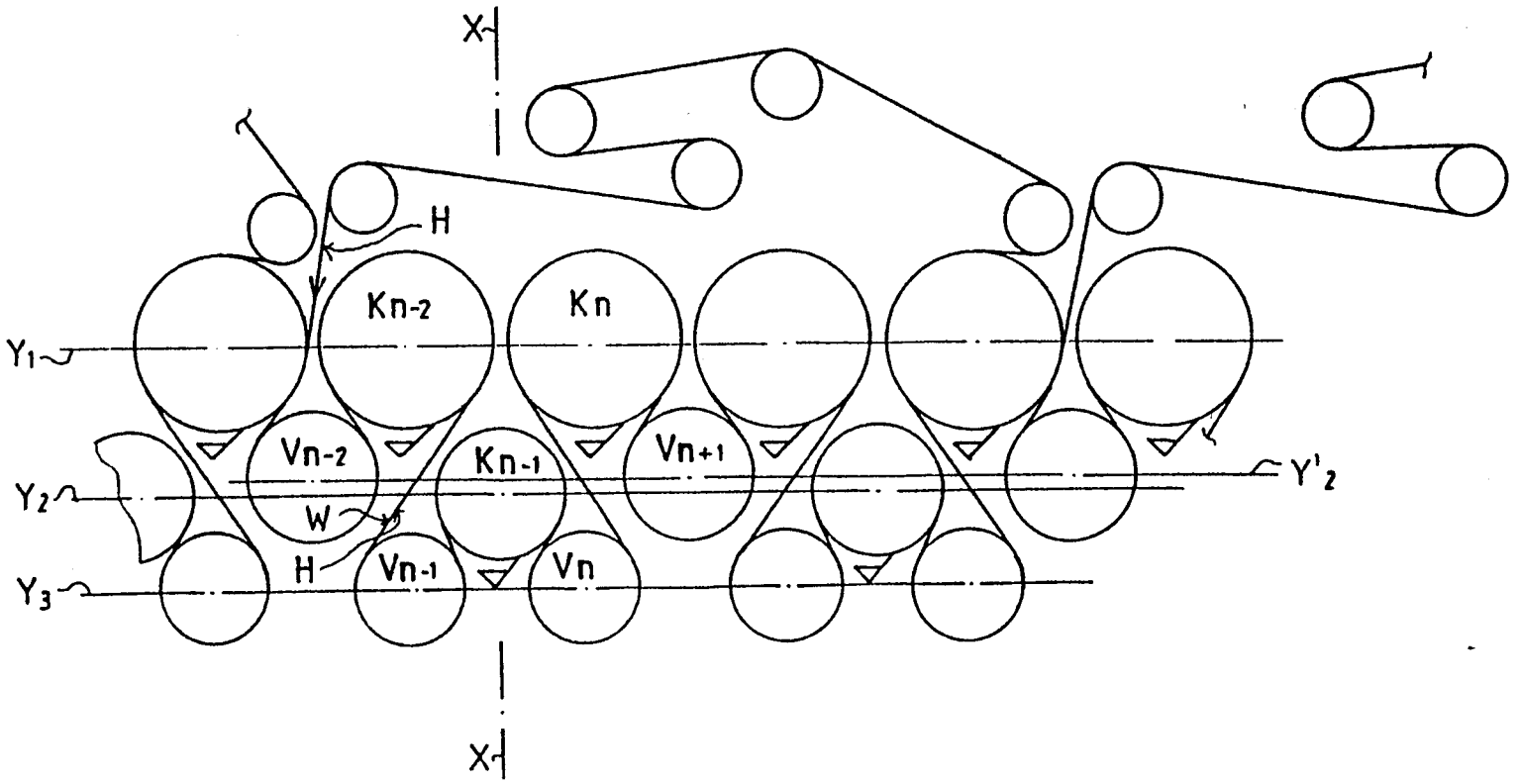
FIG. 3 is a detailed illustration of the grouping of the cylinders in a drying section in accordance with the invention.

FIG. 3 is a more detailed illustration of the grouping between the heated drying cylinders and the cold cylinders, i.e. the leading rolls. In the embodiment shown in FIG. 3, each drying group $R_1, R_2 \ldots$ consists of cylinder groupings in which the heated drying cylinders are placed at two height levels, the levels $Y_1$ and $Y_2$. The leading cylinders are placed at the height level $Y_2'$ and at the height level $Y_3$. Moreover, the diameter of the heated drying cylinder placed at the middle height level $Y_2$ is smaller than the diameter of the drying cylinder placed at the level $Y_1$.

Together with the wire H, the paper web W is passed from the leading cylinder $V_{n-2}$ of the height level $Y_2'$ onto the drying cylinder $K_{n-2}$ of the level $Y_1$. From the drying cylinder $K_{n-2}$, the web W is passed onto the leading cylinder $V_{n-1}$. From the leading cylinder $V_{n-1}$, the paper web W together with the wire H are further passed onto the middle heated drying cylinder $K_{n-1}$. From the heated drying cylinder $K_{n-1}$, the paper web W and the wire H are passed onto the second leading cylinder $V_n$ of the level $Y_3$. From the leading cylinder $V_n$, the paper web W is passed onto the second heated drying cylinder $K_n$ of larger diameter, placed at the height level $Y_1$. From the drying cylinder $K_n$, the web W is passed onto the leading cylinder $V_{n+1}$ of the height level $Y_2'$.

In a corresponding manner, the wire H is passed from one cylinder onto the other. The paper web W runs in contact with the outer faces of the heated drying cylinders K. On the leading cylinders V, the paper web W runs outermost, and the wire H is placed in contact with the outer face of the cylinders V.

In another embodiment, the leading cylinders $V_{n-1}$ and $V_n$ are placed symmetrically at the same distance from a vertical plane X drawn through the center point of the heated drying cylinder $K_{n-1}$ of smaller diameter. The heated drying cylinders $K_{n-2}$, $K_n$ of larger diameter are also placed symmetrically at equal distances from the vertical plane. In a corresponding manner, the leading cylinders $V_{n-2}, V_{n+1}$ of the height level $Y_2'$ are placed symmetrically and at equal distances from the vertical plane X.

The examples provided above are not meant to be exclusive. Many other variations of the present invention would be obvious to those skilled in the art, and are contemplated to be within the scope of the appended claims.

What is claimed is:

1. A grouping of cylinders in a drying section of a paper machine, said grouping of cylinders comprising large diameter heated drying cylinders arranged at a first height level, small diameter heated drying cylinders arranged at a second height level, said small diameter heated drying cylinders having a smaller diameter than said large diameter heated drying cylinders.

leading cylinders arranged at a third height level, a first one of said large diameter heated drying cylinders arranged in the vicinity of a first one of said leading cylinders, said first one of said leading cylinders arranged in the vicinity of a first one of said small diameter heated drying cylinders, said first one of said small diameter heated drying cylinders further arranged in the vicinity of a second one of said leading cylinders, said second one of said leading cylinders further arranged in the vicinity of a second one of said large diameter heated drying cylinders, and said grouping of cylinders arranged such that a paper web and a wire is passed from said first one of said large diameter heated drying cylinders onto said first one of said leading cylinders, and further, from said first one of said leading cylinders onto said first one of said small diameter heated drying cylinders, from said first one of said small diameter heated drying cylinders onto said second one of said leading cylinders, and from said second one of said leading cylinders further onto said second one of said large diameter heated drying cylinders.

2. A grouping of cylinders as claimed in claim 1, further comprising additional leading cylinders arranged at a fourth height level, a first one of said additional leading cylinders arranged in the vicinity of said first one of said large diameter heated drying cylinders, a second one of said additional leading cylinders arranged in the vicinity of said second one of said large diameter heated drying cylinders, and the paper web and the wire being passed from said first one of said additional leading cylinders onto said first one of said large diameter heated drying cylinders, and the paper web and the wire being passed from said second one of said large diameter heated drying cylinder onto said second one of said additional heated drying cylinders.

3. A grouping of cylinders as claimed in claim 2, wherein said small diameter heated drying cylinders and said additional leading cylinders are arranged substantially at the same height level.

4. A grouping of cylinders as claimed in claim 1, wherein said leading cylinders are arranged symmetrically in relation to and at equal distances from a vertical plane drawn through a center point of said first one of said small diameter heated drying cylinders and said large diameter heated drying cylinders being arranged symmetrically in relation to said vertical plane.

5. A grouping of cylinders as claimed in claim 1, wherein said small diameter heated drying cylinders being arranged below said large diameter heated drying cylinders, and said leading cylinders being arranged below said small diameter heated drying cylinders.

6. A grouping of cylinders as claimed in claim 1, wherein said large diameter and said small diameter drying cylinders are steam heated drying cylinders.

7. A grouping of cylinders as claimed in claim 1, wherein said leading cylinders are cold cylinders.

8. A drying group in a paper machine comprising a plurality of groupings of cylinders as claimed in claim 1.

9. A drying section of a paper machine comprising a plurality of drying groups as claimed in claim 8.

10. A drying section comprising a plurality of drying groups, each of said drying groups comprising a plurality of groupings of cylinders as claimed in claim 5, further comprising an inverted grouping of cylinders located in between a first one and a second one of said plurality of drying groups, said inverted grouping comprising additional heated drying cylinders and additional leading cylinders, said additional heated drying cylinders being arranged at a fifth height level, said additional leading cylinders being arranged at a sixth height level above said additional heated drying cylinders.

11. A grouping of cylinders as claimed in claim 2, wherein said leading cylinders have a larger diameter relative to said additional leading cylinders.

12. A method of reducing the length of a drying section of a paper machine, comprising providing a drying section with a plurality of drying groups, providing in each of said drying groups a plurality of groupings of cylinders, providing in each of said groupings of cylinders large diameter heated drying cylinders arranged at a first height level, small diameter heated drying cylinders arranged at a second height level, and leading cylinders arranged at a third height level, said small diameter heated drying cylinders having a smaller diameter than said large diameter heated drying cylinders, passing a web from a first one of said large diameter heated drying cylinders onto a first one of said leading cylinders arranged in the vicinity of said first one of said large diameter heated drying cylinder, then passing the web from said first one of said leading cylinders onto a first one of said small diameter heated drying cylinders arranged in the vicinity of said first one of said leading cylinders, then passing the web from said first one of said small diameter heated drying cylinders onto a second one of said leading cylinders arranged in the vicinity of said first one of said small diameter heated drying cylinders, and then passing the web from said second one of said leading cylinders onto a second one of said large diameter heated drying cylinders arranged in the vicinity of said second one of said leading cylinders.

13. The method of claim 12, further comprising providing in each of said groupings of cylinders additional leading cylinders arranged at a fourth height level, passing the web onto said first one of said large diameter heated drying cylinders from an adjacent one of said additional leading cylinders, and passing the web from said second one of said large diameter heated drying cylinders onto an adjacent one of said additional leading cylinders.

14. The method of claim 12, further comprising arranging said large diameter heated drying cylinders above said small diameter heated drying cylinders, and arranging said small diameter heated drying cylinders above said leading cylinders.

15. The method of claim 13, further comprising arranging said large diameter heated drying cylinders above said small diameter heated drying cylinders, arranging said small diameter heated drying cylinders above said leading cylinders, and arranging said additional leading cylinders at substantially the same height level as said small diameter heated drying cylinders.

16. The method of claim 14, further comprising providing the diameter of said additional leading cylinders with a larger diameter than the diameter of said leading cylinders.

* * * * *